US008961554B2

(12) United States Patent
Bettis

(10) Patent No.: US 8,961,554 B2
(45) Date of Patent: Feb. 24, 2015

(54) SELF-EXPANDING DILATION PLUG

(76) Inventor: Seth J. Bettis, Westminster, CO (US)

( * ) Notice: Subject to any disclaimer, the term of this patent is extended or adjusted under 35 U.S.C. 154(b) by 430 days.

(21) Appl. No.: 13/528,819

(22) Filed: Jun. 20, 2012

(65) Prior Publication Data

US 2012/0324949 A1 Dec. 27, 2012

Related U.S. Application Data

(60) Provisional application No. 61/499,320, filed on Jun. 21, 2011.

(51) Int. Cl.

| | |
|---|---|
| ***A61M 29/00*** | (2006.01) |
| ***A44C 15/00*** | (2006.01) |
| ***A44C 7/00*** | (2006.01) |

(52) U.S. Cl.

CPC ..... *A44C 15/0035* (2013.01); *A44C 7/001* (2013.01)

USPC ..... 606/198

(58) Field of Classification Search

USPC ..... 606/198, 191, 188, 194, 196, 213, 232; 623/1.11, 23.72; 63/12; 604/104

See application file for complete search history.

(56) References Cited

U.S. PATENT DOCUMENTS

| | | | | |
|---|---|---|---|---|
| 3,710,799 | A | 1/1973 | Caballero | |
| 4,759,365 | A | 7/1988 | Askinazy | |
| 6,003,333 | A | 12/1999 | Stevens | |
| 6,743,204 | B2 * | 6/2004 | Christenson et al. | 604/151 |
| 6,896,689 | B2 | 5/2005 | Gedebou | |
| 7,238,193 | B2 * | 7/2007 | Gedebou | 606/191 |
| 2004/0059368 | A1 | 3/2004 | Maryanka | |
| 2005/0149098 | A1 | 7/2005 | Gedebou | |
| 2005/0209627 | A1 | 9/2005 | Kick et al. | |
| 2008/0021496 | A1 * | 1/2008 | Narvaez | 606/198 |

* cited by examiner

*Primary Examiner* — Hung Q Nguyen
*Assistant Examiner* — Socrates L Boutsikaris
(74) *Attorney, Agent, or Firm* — Geoffrey E. Dobbin; Dobbin IP Law P.C.

(57) ABSTRACT

The present invention is a self-expanding dilation plug for use in body modification activities. The plug has a central body and a plurality of arms extending therefrom under constant spring pressure. The plug is inserted into a hole in a person's body part, such as an ear lobe, and allowed to gently stretch the tissue over time. In so doing, trauma and the risk of serious injury associated with the procedure is greatly reduced.

6 Claims, 5 Drawing Sheets

SELF-EXPANDING DILATION PLUG

CROSS-REFERENCES TO RELATED APPLICATIONS

The present invention claims priority as a non-provisional perfection of prior filed U.S. Provisional Application No. 61/499,320, filed Jun. 21, 2011, and incorporates the same by reference herein in its entirety.

FIELD OF THE INVENTION

The present invention relates to the field of body modification and more particularly relates to a plug designed to stretch, or gauge, a cartilaginous part of the body.

BACKGROUND OF THE INVENTION

Body modification encompasses any procedure that permanently changes the outward appearance of a body part and is an ancient art and practice. Body modification includes such things as tattoos, piercings and stretching, or gauging. The arts of tattooing and piercings have advanced greatly in recent years as methods and procedures have increased hygiene and stigma associated with such modifications have lessened. However, the practice of gauging is still rather primitive. The procedure dates from ancient times where a piercing, usually in the lips or ears, is gradually made larger so as to accommodate a disk or plug. Ideally, this practice takes time as a series of gradually larger plugs is placed in the piercing. This places an amount of stress on the surrounding body tissue and forces cellular growth in a manner to accommodate the plug. The process is repeated until the desired hole size is achieved.

In modern times, gauging is accomplished through using the use of a series of elongate tapers, which have a point at one size, or gauge, and a shaft of a larger gauge, and a transition between the two. In practice, the tip of the taper is positioned in the hole and the taper is forced through until the main shaft is in the hole. The taper is then left in the hole for a period of about 2 weeks and the procedure repeated as desired with larger tapers. Gauging is relatively safe when performed by a skilled practitioner. It does, however, have some risk of tearing the flesh around the hole, pain, and other complications. These risks are compounded when the process is performed by untrained individuals on themselves and friends. The process also leaves the individual with a relatively large taper in their ear, lip or other body part until the stretch is completed. This can cause a drastic change in lifestyle as the taper projects out from the hole and may catch other objects, causing further risk of injury to the gauged body part.

The present invention is a plug, insertable in a hole, which expands under spring pressure so as to gradually increase the size of the hole. By applying gentle pressure over time, the risks of tearing and trauma are drastically reduced. The plug will also present less of a profile outside the hole, thus reducing the lifestyle interference created by tapers The present invention represents a departure from the prior art in that the self-expanding dilation plug of the present invention allows for the gentle stretching of a body part without much of the trauma and difficulty associated with current gauging practices.

SUMMARY OF THE INVENTION

In view of the foregoing disadvantages inherent in the known types of gauging tools, this invention provides a self-expanding plug for the purpose of gauging. As such, the present invention's general purpose is to provide a new and improved plug that is expandable by spring pressure balanced with the natural resistance of body tissue.

To accomplish these objectives, the self-expanding dilation plug comprises a central body and a plurality of arms radiating therefrom. The each arm is biased outward by a spring positioned between the arm and the body. The outer surface of each arm presents an arcuate cradle that distributes pressure around the tissue surrounding the plug.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the self-expanding dilation plug is herein described. It should be noted that the articles "a", "an", and "the", as used in this specification, include plural referents unless the content clearly dictates otherwise.

Figure 1:
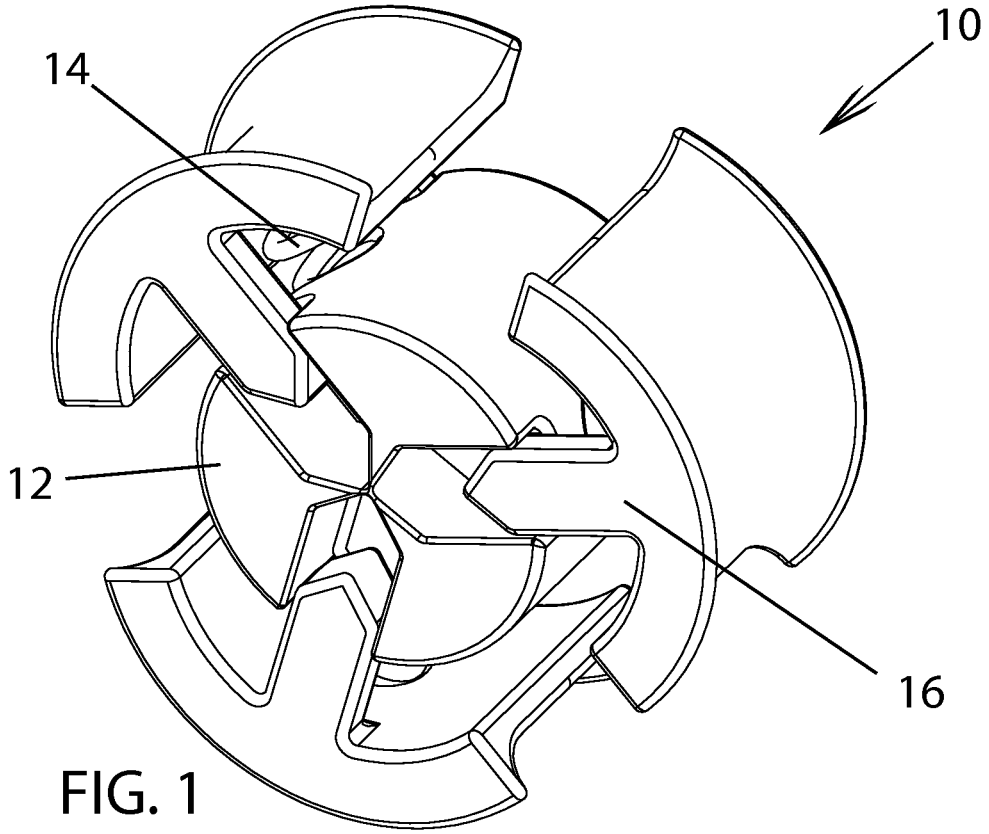
FIG. 1 is a perspective view of a plug manufactured according to the present invention, expanded.
Figure 2:
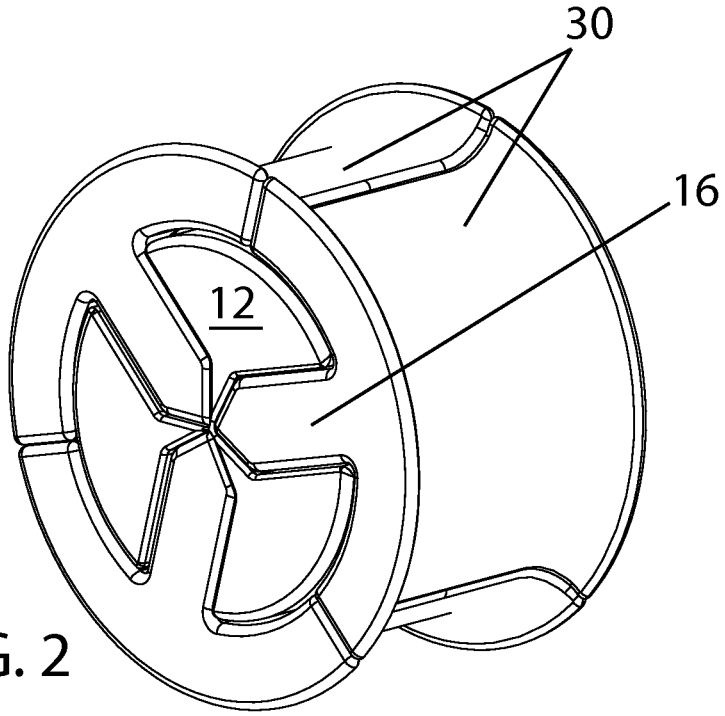
FIG. 2 is a perspective view of the plug of FIG. 1, compacted.
Figure 3:
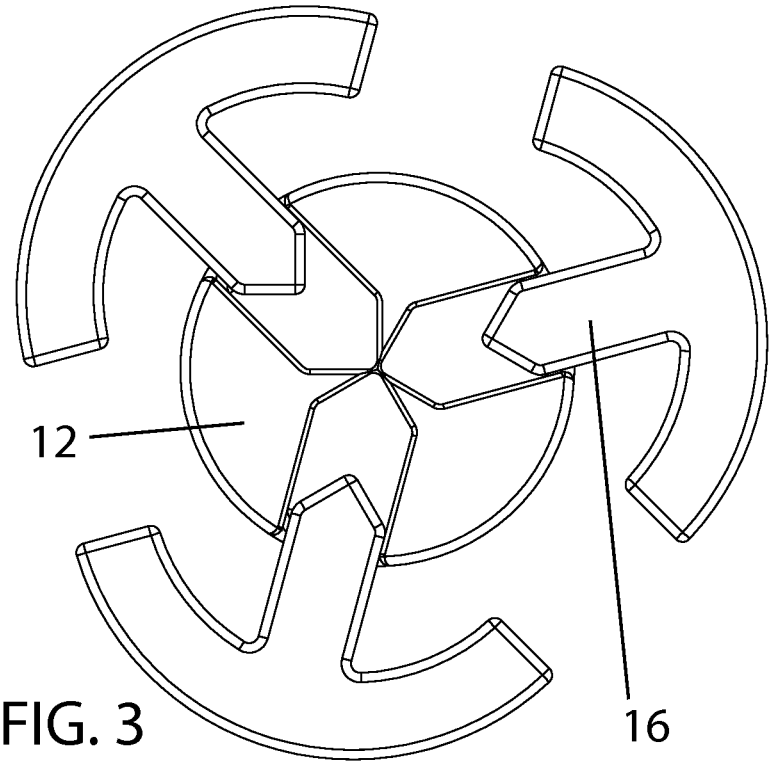
FIG. 3 is a front elevation of the plug of FIG. 1.
Figure 4:
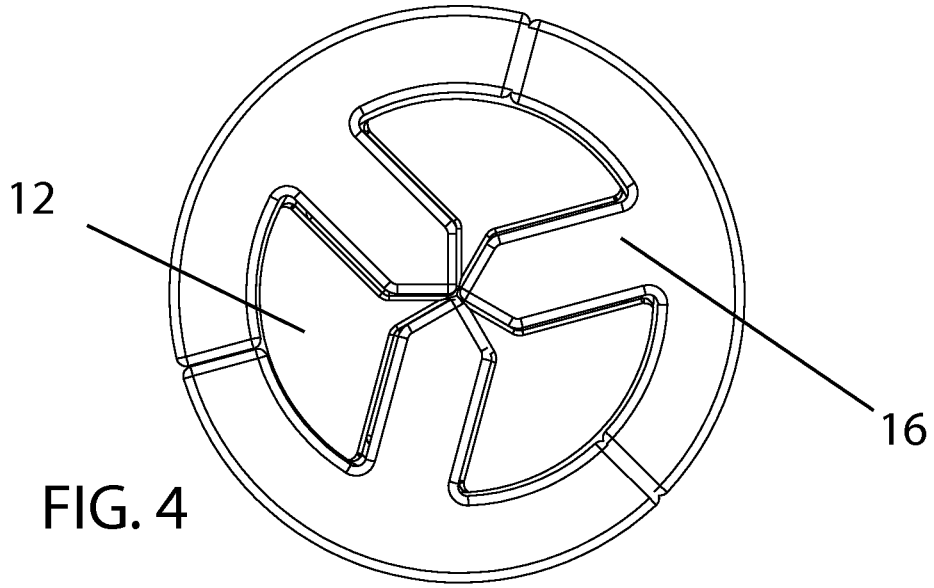
FIG. 4 is a front elevation of the plug of FIG. 1, compacted.

With reference to FIG. 1, a preferred embodiment of the plug 10 comprises a main body 12 and a plurality of arms 16 extending radially therefrom. The each arm 16 is biased outward by a spring 14, allowing them to extend outward, as shown in FIGS. 1 and 3, and compress, as shown in FIGS. 2 and 4. In its compressed state, the plug maintains a size small enough to allow insertion in a hole pierced in a body part. The full extent of the extension, then, is the desired resultant gauge.

Figure 5:
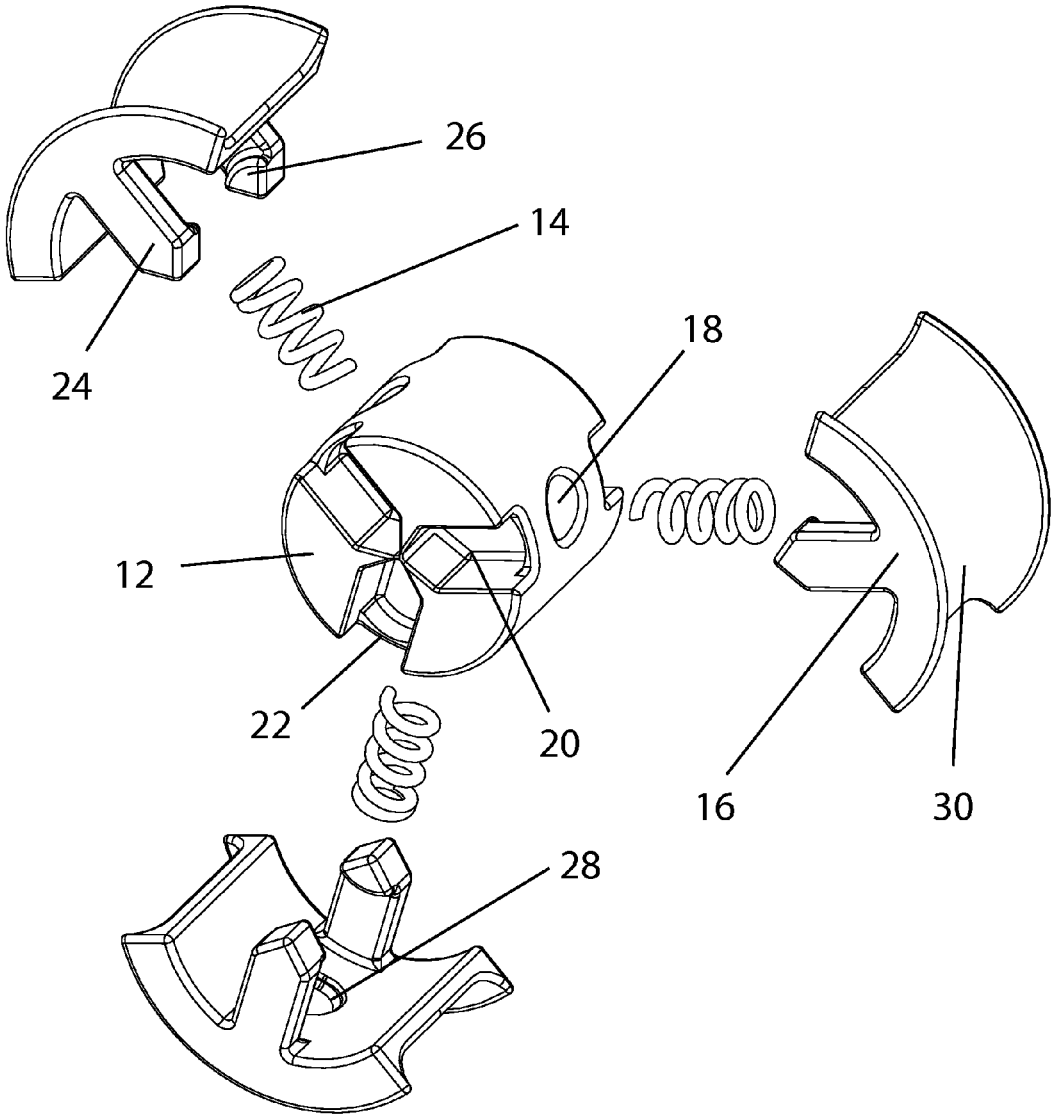
FIG. 5 is an exploded view of the plug of FIG. 1
Figure 6:
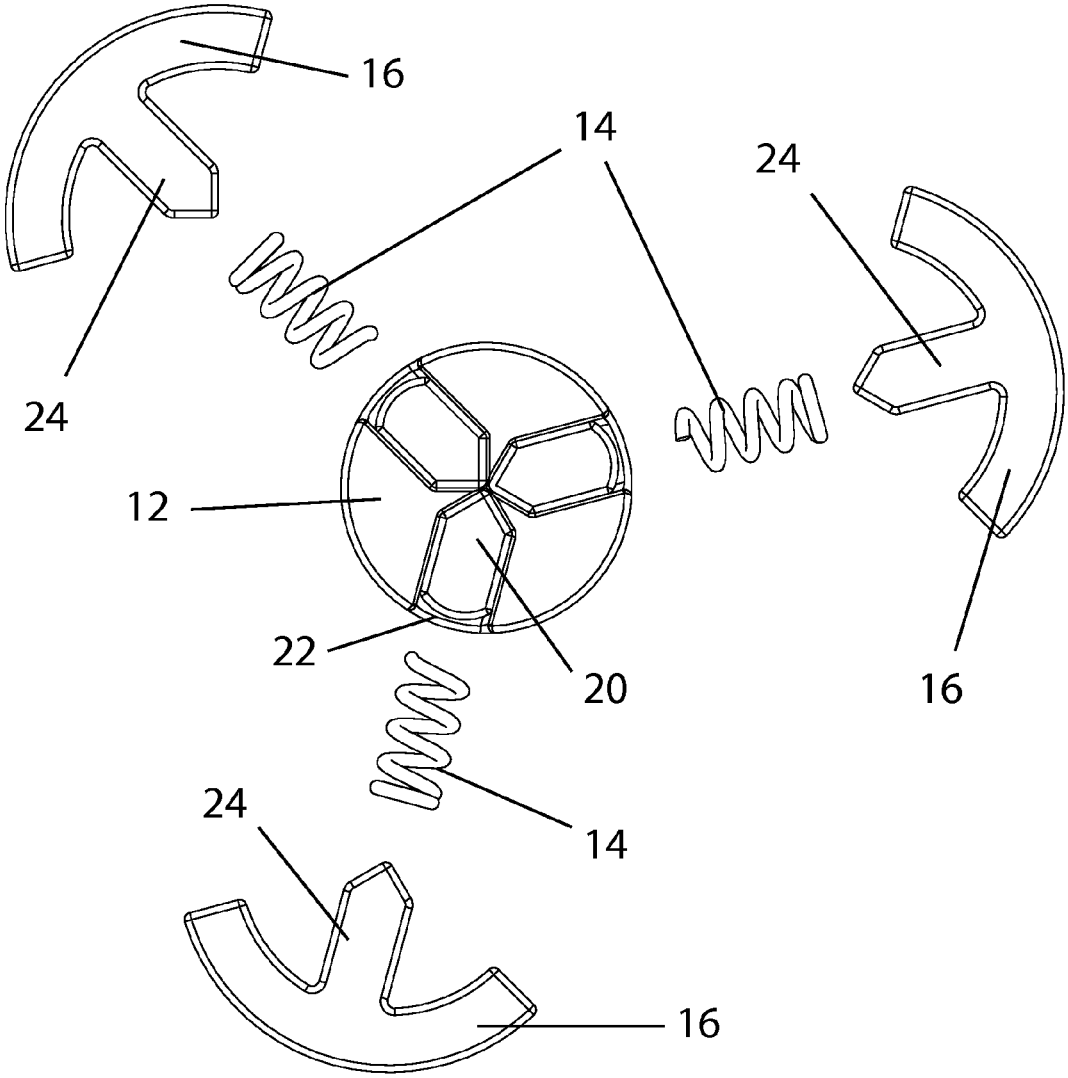
FIG. 6 is another exploded view of the plug of FIG. 1

In detailed construction, shown in FIGS. 5 and 6, the plug body 12 features pairs of channels 20 and spring bores 18 matching the number of arms 16. The channels 20 each have a facial wall 22 along the circumference of the body 12. The arms 16 feature an arcuate cradle 30 and two prongs 24 extending along a radius of the arcuate cradle 30. Each prong 24 also features a tooth 26 at its furthermost end. A detent 28 resides centrally on an underside of the arcuate cradle 30, between the prongs 24.

The plugs are assembled by each spring 14 being positioned in a spring bore 18 and having an arm 16 snapped into place over the spring 14. The end of the spring 14 not in the bore 18 then resides in the detent 28 on the underside of the cradle 30. Prongs 24 each reside in one channel 20 in a manner that tooth 26 interfaces with facial wall 22 to keep the spring 14 from forcing the arm 16 out of position.

Figure 7:
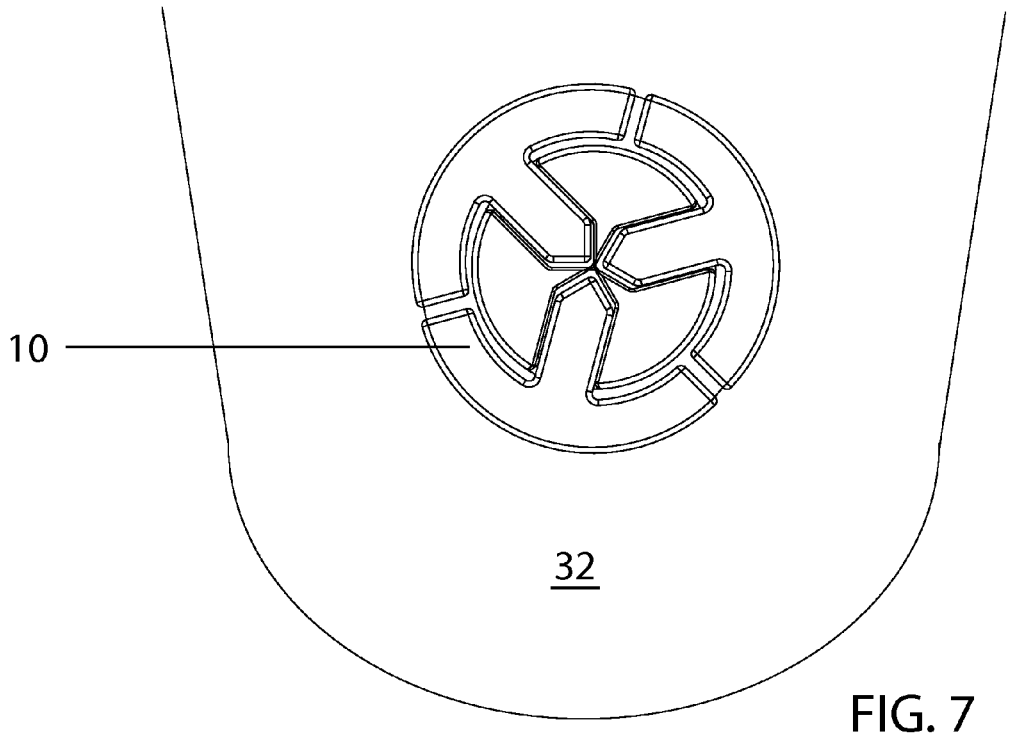
FIG. 7 is a front elevation of the plug of FIG. 1, initially inserted in an ear lobe.
Figure 8:
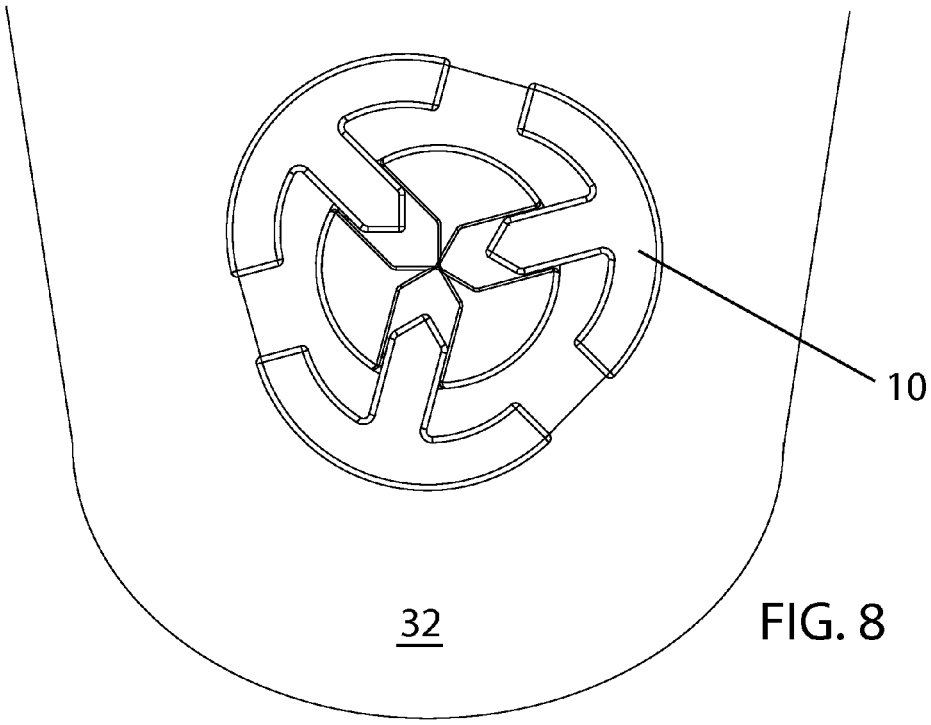
FIG. 8 is a front elevation of the plug of FIG. 7, after a stretching protocol has been completed.

In use, shown in FIGS. 7 and 8, the plug 10 is compacted and positioned in a hole already made in a body part, such as earlobe 32. The size of the plug 10 is selected based on the initial size of the hole. Over time, the constant spring pressure of the plug gently stretches the body part and enlarges the hole in that body part. This continues until the plug reaches its maximum extension and the tissues are fully stretched (FIG. 8). This process generally takes about two weeks if done properly. At this time, the process may be repeated with a larger plug so as to achieve a larger effect.

The construction of the plug is simple and should be made of non-reactive materials, such as plastic and stainless steel. However, it may be made of any material suitable for conditions. The spring force applied to the body tissue should be between 900 and 1500 grams, the recommended range of pressure to gently stretch body tissue. Ideally, the plugs are designed for a gradual increase in size of about one gauge measurement, though a larger or smaller size difference may be designed so long as upper and lower limits of the applied pressure are maintained within safe limits. In the preferred embodiment, the plug comprises three arms 16 each having an arc length of 120° and biased by three corresponding springs 14 residing in underlying equidistant spring bores 18. Easily conceivable modifications would include altering the number of arms and the number of springs biasing each arm.

Although the present invention has been described with reference to a preferred embodiment, numerous modifications and variations can be made and still the result will come within the scope of the invention. No limitation with respect to the specific embodiments disclosed herein is intended or should be inferred.

What is claimed is:

1. A self-expanding tissue dilation plug comprising:

a. a generally round plug body, said plug body further comprising:

i. a plurality of radial spring bores positioned about a circumference of the plug body;

ii. a plurality of pairs of radial channels, each pair of radial channels having a first radial channel and a second radial channel, wherein said first and second radial channels of each pair are disposed opposite the other on opposite surfaces of the plug body; and iii. a plurality of facial walls, one in each said radial channel and positioned at the circumference of the plug body;

b. a plurality of springs, one in each of said radial spring bores; and c. a plurality of arms, each said arm interfacing with at least one of said springs and at least one of said pairs of radial channels and further comprising:

i. an arcuate cradle, following a curvature of the plug body and residing over at least one of said springs; and ii. at least one pair of toothed prongs, each pair of toothed prongs having a first toothed prong and a second toothed prong, wherein the first toothed prong resides within the first radial channel of each pair of radial channels, and the second toothed prong resides within the second radial channel of each pair of radial channels, such that each said prong is slidable along the corresponding radial channel and is prevented from exiting the corresponding radial channel by interface of its tooth with the facial wall of the corresponding radial channel;

wherein the plug is compressible to an insertion state and, when positioned in an orifice in a body part, will impart a spring pressure on surrounding tissues and slowly expand the orifice.

2. The self expanding dilation plug of claim 1, wherein the springs impart a constant spring force of between 900 and 1500 grams of pressure to a surrounding tissue.

3. The self expanding tissue dilation plug of claim 1, wherein each of said arcuate cradles has at least one detent with which to interface with each at least one of said springs.

4. A self-expanding tissue dilation plug comprising:

a. a generally round plug body, said plug body further comprising:

i. three radial spring bores positioned equidistantly about a circumference of the plug body;

ii. three pairs of radial channels, each pair of radial channels having a first radial channel and a second radial channel, wherein said first and second radial channels of each pair are disposed opposite the other on opposite surfaces of the plug body and each said pair is positioned adjacent to one of said spring bores; and iii. six facial walls, one in each said radial channel and positioned at the circumference of the plug body;

b. three springs, one residing in each of said spring bores; and c. three arms, each said arm interfacing with one of said springs and one of said pairs of radial channels and further comprising:

i. an arcuate cradle, following a curvature of the plug body and residing over the corresponding spring; and ii. a pair of toothed prongs, each pair of toothed prongs having a first toothed prong and a second toothed prong, wherein the first toothed prong resides within the first radial channel of each pair of radial channels, and the second toothed prong resides within the second radial channel of each pair of radial channels, such that each said prong is slidable along the corresponding radial channel and is prevented from exiting the corresponding radial channel by interface of its tooth with the facial wall of the corresponding channel;

wherein the plug is compressible to an insertion state and, when positioned in an orifice in a body part, will impart a spring pressure on surrounding tissues and slowly expand the orifice.

5. The self expanding tissue dilation plug of claim 4, wherein the springs impart a constant spring force of between 900 and 1500 grams of pressure to a surrounding tissue.

6. The self expanding tissue dilation plug of claim 4, wherein each of said arcuate cradles has at least one detent with which to interface with each at least one of said springs.

* * * * *